US006257740B1

(12) United States Patent
Gibboney, Jr.

(10) Patent No.: US 6,257,740 B1
(45) Date of Patent: Jul. 10, 2001

(54) LAMP FOR USE IN LIGHT STRINGS

(76) Inventor: James W Gibboney, Jr., 3910 Dial Mill Rd., Conyers, GA (US) 30208

( * ) Notice: Subject to any disclaimer, the term of this patent is extended or adjusted under 35 U.S.C. 154(b) by 0 days.

(21) Appl. No.: 09/502,909

(22) Filed: Feb. 11, 2000

(51) Int. Cl.[7] ..... F21V 9/00

(52) U.S. Cl. ..... 362/288; 439/375; 439/654; 200/51.1

(58) Field of Search ..... 362/255, 285; 439/375, 654, 599, 619, 699.2, 188; 200/51.1

(56) References Cited

U.S. PATENT DOCUMENTS

| | | | | |
|---|---|---|---|---|
| 4,720,272 | * | 1/1988 | Durand | 439/375 |
| 5,453,664 | | 9/1995 | Harris | 315/185.5 |
| 5,456,620 | * | 10/1995 | Kaminski | 439/654 |
| 5,707,136 | | 1/1998 | Byers | 362/145 |
| 5,709,457 | | 1/1998 | Hara | 362/96 |
| 5,720,544 | | 2/1998 | Shu | 362/226 |
| 5,722,766 | | 3/1998 | Shu | 362/226 |
| 5,727,872 | | 3/1998 | Liou | 362/252 |
| 5,759,062 | | 6/1998 | Chen | 439/419 |
| 5,775,933 | | 7/1998 | Chen | 439/419 |
| 5,788,361 | | 8/1998 | Karl Lee | 362/249 |
| 5,791,765 | | 8/1998 | Lin | 362/249 |
| 5,791,940 | | 8/1998 | Chen | 439/619 |
| 5,794,189 | | 8/1998 | Liou | 704/231 |
| 5,807,134 | | 9/1998 | Hara | 439/419 |
| 5,816,849 | | 10/1998 | Schmidt | 439/505 |
| 5,816,862 | | 10/1998 | Tseng | 439/699.2 |
| 5,828,183 | | 10/1998 | Wang et al. | 315/185.5 |
| 5,834,901 | | 11/1998 | Shen | 315/185.5 |
| 5,839,819 | | 11/1998 | Pan | 362/252 |
| 5,848,838 | | 12/1998 | Presta | 362/249 |
| 5,854,541 | | 12/1998 | Chou | 315/185 R |
| 5,860,731 | | 1/1999 | Martinez | 362/252 |
| 5,860,830 | | 1/1999 | Wu | 439/419 |

* cited by examiner

*Primary Examiner*—Sandra O'Shea
*Assistant Examiner*—Hargobind S. Sawhney
(74) *Attorney, Agent, or Firm*—Michael A. Mann; Nexsen Pruet Jacobs & Pollard LLC

(57) ABSTRACT

A lamp having a light bulb connected to a base insertable into a light socket in such a way that insertion breaks an electrical circuit between two spring terminals inside the socket and reestablishes it through the lead wires on the light bulb. The light bulb has a filament and two lean wires connected to the filaments. The filaments extend from the bottom of the base and are bent outwardly and upwardly around the base. The bulb with its base are insertable into the light socket. Wires from a source of electricity enter the socket and form electrical terminals, one on either side of the socket. Two spring terminals within the socket are biased toward each other and will conduct when supplied with an electrical potential unless separated. A protrusion on the base of the light bulb separates the spring terminals. Thus, in a light string where the lights are electrically in series, removal of a light bulb of the present invention will not cause the string to go out.

12 Claims, 3 Drawing Sheets

LAMP FOR USE IN LIGHT STRINGS

FIELD OF INVENTION

The present invention relates to a lamp for use in light strings and more particularly to a light bulb base used in conjunction with a socket that will continue to conduct electricity and keep the remainder of the string of lights lit even when one or more individual light bulbs are missing from the socket.

BACKGROUND OF THE INVENTION

Light strings having lights connected electrically in a series are well known especially around the holidays when such light strings are used for decorative purposes. Generally, the lights in the string are electrically in series rather than in parallel. One particular drawback to these types of light strings is that when a light bulb is removed from the socket, the entire series is rendered inoperable. Each light bulb within its respective socket completes the electrical circuit so when a light bulb is removed or the filament burns out within the light bulb, a gap is created in the circuit and electricity is unable to continue to flow through the circuit. When a "good" light bulb is inserted into the socket, it completes the circuit, thus allowing electricity to flow uninterrupted.

One solution that allows the circuit to continue to function without a light bulb being in the socket is found in U.S. Pat. No. 5,453,664, issued to Harris and entitled "Light String With Improved Shunt System". The Harris patent is directed to a bulb shunt system that is configured to shunt the electric current passing through the light bulbs if a filament breaks or is removed from the socket.

The Harris system has a first shunt located inside the glass envelope of the light and a second shunt is located either in the lamp holder or in the socket. The combined resistance of the shunts is greater than the resistance of the light bulb therefore allowing the string to remain lit.

While the Harris device allows for the electrical current to continue if a light bulb is damaged and remains within the socket or if the light bulb is completely removed from the string of lights, it requires special light bulbs designed to include the first of the two shunts. This system also requires a second shunt system to be made within the socket, therefore creating an extra shunt to be present in every socket/light bulb combination. That is, only one shunt is utilized at a time and an extra or excess shunt is present in every lamp. Moreover, when a bulb is remove, such as when it has been burned out, without turning out the light, the shunt welds and thereby prevents the replacement bulb from lighting. Finally, as each socket's shunt welds, the voltage across the remaining lamps increases, thereby reducing the life of these bulbs, and causing a cascading of bulb breakdowns.

While the above stated devices are a fair representation of the current prior art, there remains room for improvement as defined by the currently claimed invention.

SUMMARY OF THE INVENTION

The lamp of this invention allows for the electrical current in a system to continue to flow when the light bulb base has been removed completely from the socket. This is accomplished by having a light bulb with filaments, mounted within a light bulb base. Two wires are connected to the filaments in the bulb and extend from the interior of the light bulb out through the bottom of the base. On the exterior of the base, the wires are bent outwardly and upwardly around the base. The bulb with its base is inserted into a light socket. Wires from a source of electricity enter the socket and make contact with two spring terminals, one on either side of the socket. These two spring terminals within the socket are biased toward one another. Therefore, unless separated, they would touch and would short the circuit by conducting electricity from one of the spring terminals to the other, thus continuing to conduct electricity without a load. The base of the light, however is modified to force the spring terminals apart when the light base is inserted into the socket. When the spring terminals are separated, electricity can flow through the light bulb, enabling it to light.

The present invention has numerous features and advantages associated therewith.

The lamp herein described has an advantage of keeping the remainder of lights within a string of lights lit when a light bulb is missing from one or more light bulb sockets. This is accomplished by continuing to conduct electricity through the light bulb socket even when a light bulb base is not present within the socket.

One unique feature of the light bulb socket is the two spring terminals that spring into electrical contact with one another when a light bulb base is not present in the socket. Due to the physical meeting of the two spring terminals, the opportunity for arcing is reduced. The electrical current flows from one spring terminal to the other and is never given the opportunity to arc.

The present light bulb base is easy to manufacture and use, thus making it economical.

The description of the present invention discloses, in conjunction with the drawings which illustrate by way of example, the principles and objects of the invention.

DETAILED DESCRIPTION OF PREFERRED EMBODIMENTS

Figure 1:
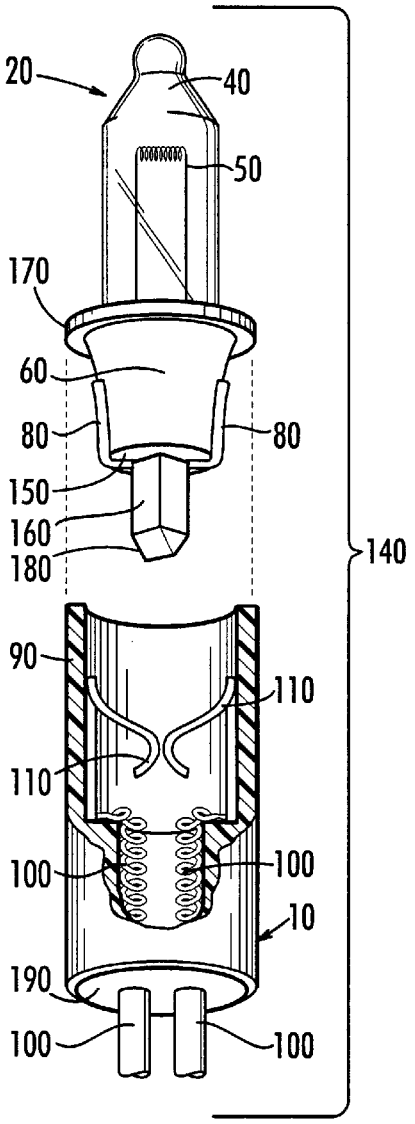
FIG. 1 is an exploded, partially cross sectional, perspective view of a lamp for use in string lights according to a first embodiment of the present invention.

FIG. 1 is an exploded, partially cut away, perspective view of a first embodiment of a lamp for use in string lights. The lamp 140 has a light bulb 20 in a base 60 that can be removably received in a light bulb socket 10 dimensioned to receive base 60.

The light bulb 20 has a globe 40 connected to base 60. Globe 40 can be made of any conventional transparent or translucent material such as plastic or glass. Within globe 40 is a filament 50 that extends down through base 60 and exits through base 60. The ends of filament 50 that exit to the exterior of base 60 are lead wires 80 which protrude out through a bottom 150 of base 60. Lead wires 80 wrap around base 60 and extend upwardly in the direction of globe 40, adjacent the base 30.

On the exterior of base 60, located in the central region and between where the lead wires 80 exit the lower portion of base 60, a separator 160 protrudes in a downwardly direction away from base 60 light bulb 20.

Separator 160 may have a pointed or rounded tip 180 that facilitates separation of two spring terminals 110 when they are together. Separator 160 serves to sever the physical and electrical connection between spring terminals 110 thereby eliminating any alternative, electrically conductive path for the electrical current to flow other than through lead wires 80 and into filament 50, thus illuminating light bulb 20.

When light base 60 is removed from the socket 10, spring terminals 110, which are biased toward one another with sufficient force so that they meet each other to form a connection through which electrical current can flow.

The light bulb socket 10 has a housing 90 which carries spring terminals 110, each of which is connected electrically to one of two socket terminals 170 and in turn to at least two terminal wires 100.

Each socket terminal 170, is an extension of each respective terminal wire 100. The terminal wires 100 are connected to an outside electrical power source.

The terminal wires 100 are carried from the exterior to the interior of housing 90. Each terminal wire 100 is connected at one end to a spring terminal 110 and a lead 80. Terminal wire 100 then extends through the bottom 190 of the socket 10 and is ultimately connected to an electrical source. Therefore, electrical current is introduced into the socket 10 by the terminal wires 100 and conducted either through spring terminals 110 if they are touching or through lead wires 80 to filament 50. Regardless of path, the current will flow and the circuit remains closed.

Figure 2A:
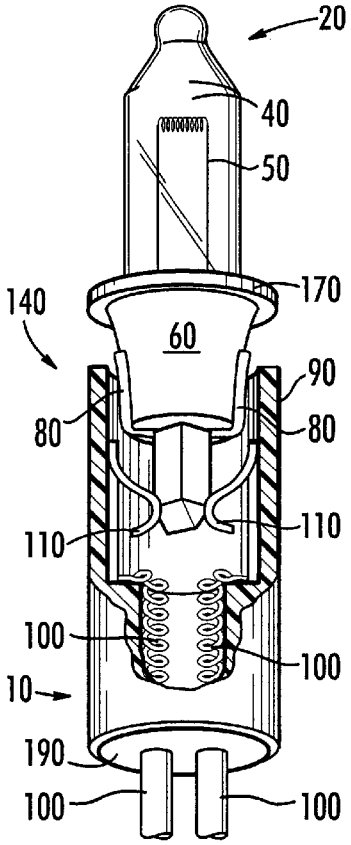
FIGS. 2A and 2B are partially cross sectional, perspective views of the first embodiment of the lamp shown entering and in a joined position, respectively.
Figure 2B:
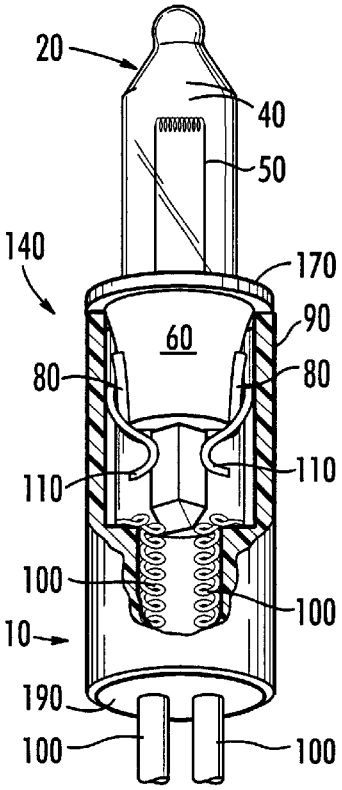

FIGS. 2A and 2B are partial cross sectional, perspective views of the first embodiment of the lamp 140 illustrating light bulb 20 being inserted into and fully seated in base 60. As base 60 is inserted into the socket 10, electrical current flowing through spring terminals 110 is interrupted when physical contact between spring terminals 110 is broken and is allowed to flow through the lead wires 80 and up through the filament 50, hence illuminating the light bulb 20. The current then resumes flowing out through the opposite side of the filament 50 from which it entered and down through the other lead wire 80, passing through the other terminal wire 100 until it exits that particular lamp 140. A flange 170 engages housing 90 when light bulb 20 is fully seated in light socket 10.

Figure 3:
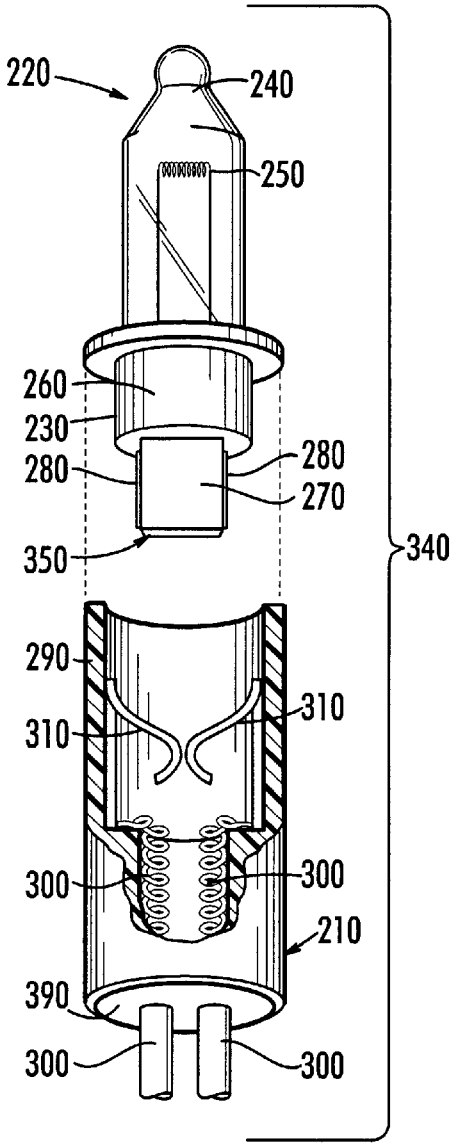
FIG. 3 is an exploded, partially cross sectional, perspective view of a lamp for use in string lights according to a second embodiment of the present invention.

FIG. 3 is an exploded, partial cross sectional, perspective view of a second embodiment of a lamp 340 for use in string lights and shown in a separated position. The light bulb 220 has a filament 250 inside a globe 240. Filament 250 is connected to a plurality of lead wires 280 that extend through a base 230, follow a separator 270 and emerge from a bottom 350 of separator 270. Outside base 230, lead wires 280 are bent outwardly and upwardly around member 270 in the direction of light bulb 220.

Light bulb 220, with base 230, is adapted to be inserted into a light bulb socket 210, which is dimensioned to receive base 230. Light bulb socket 210 has a housing 290 within which base 230 of the light bulb 220 is receivable and which also houses the elements necessary to form an electrical connection and complete an electrical circuit with a source of electricity.

Figure 4A:
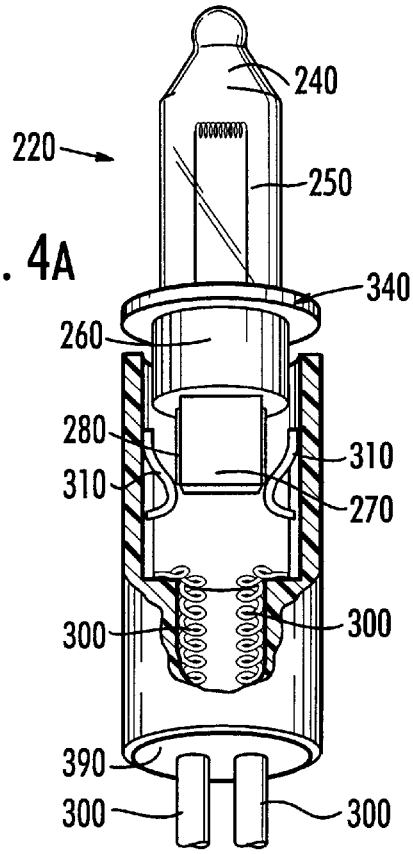
FIGS. 4A and 4B are partially cross sectional, perspective views of the second embodiment of the lamp shown entering and in a joined position, respectively.
Figure 4B:
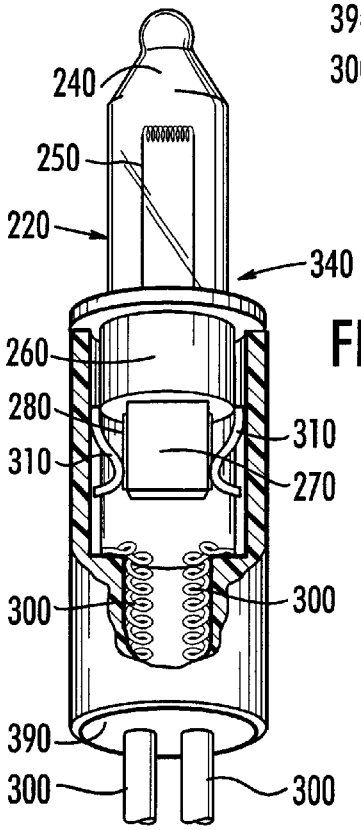

Light bulb socket 210 carries two terminal wires 300 connected thereto. Terminal wires 300 extend from a source of electricity and enter light bulb socket 210 where they are connected electrically with two spring terminals, preferably one on each side of light bulb socket 210. Spring terminals 310 within light bulb socket 210 are biased toward one another. Unless separated, the two spring terminals 310 touch and can short the circuit by conducting electricity from one of the spring terminals 310 to the other spring terminal 310. Insertion of light bulb base 230 (as best seen in FIGS. 4A and 4B) causes separator 270 to force the spring terminals 310 apart. Separator 270 is formed to facilitate separation of spring terminals 310. When spring terminals 310 are thus disconnected, electricity can flow through light bulb 220, completing the circuit through leads wires 280 and filament 250. Unlike the first embodiment of the present invention, electrical current always flows through spring terminals 310, either directly from one spring terminal 310 to the other or through lead wires 280 and filament 250.

Figure 5A:
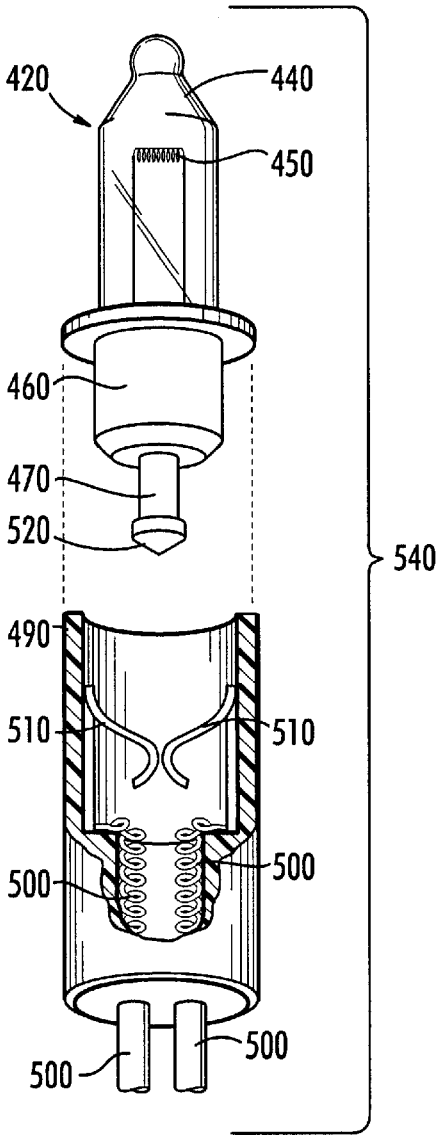
FIG. 5 is an exploded, partially cross sectional view of a lamp for use in light strings according to a third preferred embodiment of the present invention.
Figure 6A:
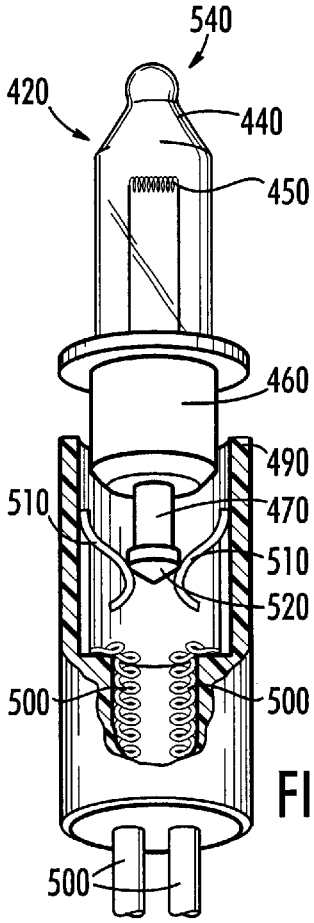
FIGS. 6A and 6B are partially cross sectional, perspective views of the third embodiment of the lamp shown entering and in a joined position, respectively.
Figure 6B:
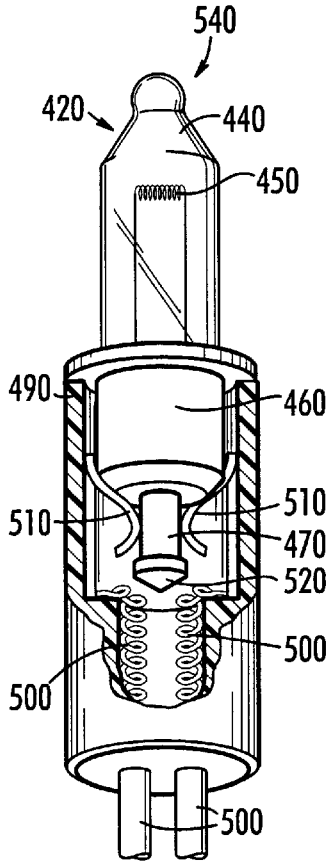

FIGS. 5, 6A and 6B illustrate a third embodiment of the present lamp, indicated generally by reference number 540. Again, a light bulb 420 is receivable in a light socket 410. Lightbulb 420, as before has a globe 440 attached to a base 460 with a separator 470 that, when base 460 is inserted into light socket 420, forces apart two spring terminals 510 carried by a housing 490 of light socket 410 to interrupt the flow of electricity from one spring terminal 510 to the other but to redirect it through a pair of lead wires 480 on either side of base 460. Lead wires 480 are in electrical connection with a filament 450 inside globe 440. As long as electricity is supplied to lead wires 480 through terminals 500, light bulb 420 will light. Removal of light bulb 420 from light socket 410 lifts separator 470 clear of spring terminals 510, thus causing them to spring together and allow current to flow between them. As long as current is flowing either between spring terminals 510 or from them to filament 450 via lead wires 480, the series of light bulbs of which light bulb 420 is a member will remain lit.

In this embodiment, separator 470 has an enlarged end at 520 which acts as a lock in the sense of a barrier that resists removal of light bulb 420. Enlarged end 520 is also formed to facilitate separation of spring terminals 510.

Spring terminals 110, 310, and 510 are preferably made of a resilient, conductive metal such as steel or copper and are also preferably made of the same material as leads 80, 280 and 480, respectively, and terminals 100, 300, and 500, respectively.

The description of the present invention discloses, in conjunction with the drawings, the features and advantages of the invention.

What is claimed is:

1. A lamp for use in light strings, said lamp comprised of:

a light bulb having a base and a pair of lead wires extending from said base;

a socket dimensioned to receive said light bulb, said socket having two spring terminals carried therein, said base of said light bulb forcing said spring terminals apart when said light bulb is seated in said socket, said spring terminals springing together when said light bulb is removed from said socket; and a pair of terminals running into said socket, said spring terminals and said lead wires being in electrical connection with said pair of terminals when said light bulb is in said socket.

2. The lamp as recited in claim 1, wherein said base carries a separator formed to separate said spring terminals when said light bulb is inserted into said socket.

3. The lamp as recited in claim 1, further comprising means for locking said base to resist removal from said socket.

4. The lamp as recited in claim 1, wherein said base is formed to facilitate separation of said spring terminals and to resist removal of said base from said socket.

5. The lamp as recited in claim 1, wherein said spring terminals conduct by touching each other directly when said light bulb is removed and when said spring terminals are forced apart by the light bulb conduct through said lead wires when said light bulb is received in said socket.

6. The lamp as recited in claim 1, wherein said spring terminals conduct directly when said light bulb is removed and do not conduct when said light bulb inserted in said socket, forces the spring terminals apart is inserted in said socket.

7. A lamp for use in light strings, said lamp comprised of:

a light bulb having a base with a separator, and a pair of lead wires extending from said base;

a socket dimensioned to receive said light bulb, said socket having two spring terminals carried therein, said separator of said light bulb forcing said spring terminals apart when said light bulb is seated in said socket, said spring terminals springing together when said light bulb is removed from said socket; and a pair of terminals running into said socket, said spring terminals and said lead wires being in electrical connection with said pair of terminals when said light bulb is inserted in said socket.

8. The lamp as recited in claim 7, wherein said lead wires extend from said separator.

9. The lamp as recited in claim 7, wherein said separator carries means for resisting removal of said light bulb from said socket.

10. The lamp as recited in claim 7, wherein said separator carries means for facilitating separation of said spring members.

11. The lamp as recited in claim 7, wherein said spring terminals conduct by touching each other directly when said light bulb is removed and when said spring terminals are forced apart by the light bulb conduct through said lead wires when said light bulb is received in said socket.

12. The lamp as recited in claim 7, wherein said spring terminals conduct directly when said light bulb is removed and do not conduct when said light bulb inserted in said socket, forces the spring terminals apart is inserted in said socket.

* * * * *